US005970452A

United States Patent [19]

Aktas et al.

[11] Patent Number: 5,970,452

[45] Date of Patent: Oct. 19, 1999

[54] METHOD FOR DETECTING A SIGNAL PAUSE BETWEEN TWO PATTERNS WHICH ARE PRESENT ON A TIME-VARIANT MEASUREMENT SIGNAL USING HIDDEN MARKOV MODELS

[75] Inventors: Abdulmesih Aktas, München; Klaus Zünkler, Dachau, both of Germany

[73] Assignee: Siemens Aktiengesellschaft, Munich, Germany

[21] Appl. No.: 08/894,977

[22] PCT Filed: Mar. 4, 1996

[86] PCT No.: PCT/DE96/00379

§ 371 Date: Sep. 4, 1997

§ 102(e) Date: Sep. 4, 1997

[87] PCT Pub. No.: WO96/28808

PCT Pub. Date: Sep. 19, 1996

[30] Foreign Application Priority Data

Mar. 10, 1995 [DE] Germany ..... 195 08 711

[51] Int. Cl.[6] ..... G10L 5/06

[52] U.S. Cl. ..... 704/253; 704/233; 704/244; 704/256

[58] Field of Search ..... 704/244, 253, 704/243, 234

[56] References Cited

U.S. PATENT DOCUMENTS

| | | | |
|---|---|---|---|
| 4,481,593 | 11/1984 | Bahler | 704/253 |
| 4,713,777 | 12/1987 | Klovstad et al. | 704/233 |
| 4,811,399 | 3/1989 | Landell et al. | 704/253 |
| 4,918,687 | 4/1990 | Bustini et al. | 370/235 |
| 5,226,091 | 7/1993 | Howell et al. | 382/107 |
| 5,293,452 | 3/1994 | Picone et al. | 704/250 |
| 5,369,728 | 11/1994 | Kosaka et al. | 704/254 |
| 5,465,317 | 11/1995 | Epstein | 704/236 |
| 5,611,019 | 3/1997 | Nakatoh et al. | 704/233 |

FOREIGN PATENT DOCUMENTS

| | | | |
|---|---|---|---|
| 0 203 401 | 12/1986 | European Pat. Off. | G10L 5/06 |
| 0 392 412 | 10/1990 | European Pat. Off. | G10L 3/00 |
| 0 625 775 | 11/1994 | European Pat. Off. | G10L 5/06 |
| 33 37 353 A1 | 4/1984 | Germany | G10L 5/06 |

OTHER PUBLICATIONS

Pattern Recognition, vol. 27, No. 10, Oct. 1994, Bose et al, Connected and Degraded Text Recognition Using Hidden Markov Model, pp. 1345–1363.

American Telephone and Telegraph Company, The Bell System Technical Journal, vol. 54, No. 2, Feb. 1975, Rabiner et al, An Algorithm for Determining the Endpoints of Isolated Utterances, pp. 297–315.

IEEE International Conference on Acoustics, Speech and Signal Processing, (1991), J.H. Hansen, Speech Enhancement Employing Adaptive Boundary Detection and Morphological Based Spectral Constraints, pp. 901–904.

DAGM–Symposium, Erlangen, H. Katterfeldt, Sprachbestimmung Mit Polynom Klassifikatoren, pp. 180–184. (In German).

IEEE Transactions on Acoustics, Speech and Signal Processing, vol. ASSP 27, No. 2, Apr. 1979, Steven Boll, Suppression of Acoustic Noise in Speech Using Spectral Subtraction, pp. 113–120.

Proceedings of the IEEE, vol. 63, No. 12, (1975), B. Widrow et al, Adaptive Noise Cancelling: Principles and Applications, pp. 1692–1716.

IEEE Transactions on Acoustics, Speech and Signal Processing, (1986), Rabiner et al, An Introduction to Hidden Markov Models, pp. 4–16.

*Primary Examiner*—David R. Hudspeth
*Assistant Examiner*—Donald L. Storm
*Attorney, Agent, or Firm*—Hill & Simpson

[57] ABSTRACT

The method recognizes a signal pause between two patterns that are present in a time-variant measurement signal and that are recognized using hidden Markov models. In a first signal processing stage, feature vectors are formed periodically for pattern recognition, which describe a signal curve of a measurement signal within a time slice. No speech pause is detected by a pause detector contained therein in a first time slice based on present features of a first feature vector. In a second signal processing stage, in a second time slice that follows the first time slice the first feature vector is compared with at least two hidden Markov models, of which at least one has been trained to a pattern to be recognized and another has been trained to a pattern characteristic for a pause. If in the comparison of the first feature vector with the hidden Markov models, a greater probability results for the presence of a pause, pause information concerning the presence of a pause, the pause information, is forwarded to a pause detector in the first signal processing stage. The measurement signal is treated as a signal pause, at least in the second time slice.

11 Claims, 2 Drawing Sheets

METHOD FOR DETECTING A SIGNAL PAUSE BETWEEN TWO PATTERNS WHICH ARE PRESENT ON A TIME-VARIANT MEASUREMENT SIGNAL USING HIDDEN MARKOV MODELS

BACKGROUND OF THE INVENTION

In many technical processes, pattern recognition acquires increased importance, since an increasing degree of automatization can thereby be achieved. Pattern recognition processes can as a rule be reduced to a time-variant measurement signal derived in a suitable way from the patterns to be recognized. However, in the automatic analysis of this measurement signal the problem arises that these measurement signals are not present in pure form, but rather are overlaid with stationary or non-stationary disturbing signals. In the examination of measurement signals derived from naturally uttered speech, these disturbing portions of the measurement signal are for example caused by background noises, breathing noises, machine noises, or also by the recording medium and the transmission path. Since the measurement signal is never present in pure form, it is particularly important to distinguish between the portions of the measurement signal containing the pattern to be recognized and other portions in which no pattern is present. For the better recognition of the patterns, it is thus particularly important to know exactly when patterns are present in the measurement signal and when no patterns, i.e. signals not resulting from the pattern are present as pause signals in the measurement signal.

A pause detection is for example also important in order to achieve a reduction in the quantity of the transmitted data, for example in speech communication channels and also in satellite transmission, for general distinguishing of useful signal from disturbing signal in signal processing, or else to find the end of an expression in the automatic speech recognition system. A robust pause detector thereby serves for the improvement of the efficiency of speech-controlled systems. This holds in particular for speech recognition systems, since what is concerned there is the comparison of a spoken expression as a pattern with an already-existing version. The problematic of pause determination specifically in automatic speech recognition has been described extensively by Rabiner (L. R. Rabiner and M. Sambur (1995), "An Algorithm for Determining the Endpoints of Isolated Utterances", The Bell system Technical Journal, 54(2), pages 297–315). He has also indicated an algorithm for pause detection. There, for pause detection items of information are taken into account that are calculated directly from the sampled time signal (energy, zero crossing rate, etc.). This procedure is common to all known pause detectors (J. H. Hansen, "Speech Enhancement Employing Boundary Detection and Morphological Based Spectral Constraints", IEEE International Conference On Acoustics, Speech and Signal Processing, pages 901–904, Toronto, ICASSP). As a rule, they use a more or less complicated control apparatus to carry out the classification of the pauses from the calculated features. As an alternative, statistical classifiers have also been used (H. Katterfeldt, "Sprachbestimmung mit Polynom Klassifikatoren", Proceedings Mustererkennung 7, DAGM-Symposium, Erlangen, pages 180–184). Due to this procedure, all these methods can operate only up to a certain disturbance level. The limit depends on the type of disturbance. They can no longer be used with small signal-noise ratios, since as a rule pause detectors are threshold-controlled. However, given very low signal to noise ratios, in environments with disturbances the current decision criteria with thresholds fail. In addition, there are non-stationary disturbances with a character similar to a signal, which can hardly be detected.

Previous approaches to the determination of speech pauses use e.g. a local parameter, i.e. one obtained on the basis of a temporal or, respectively, spectral item of frame information, for the detection of signal or, respectively, non-signal regions (S. Boll, (1979), "Suppression of Acoustic Noise In Speech Using Spectral Subtraction", IEEE Transactions on Acoustics, Speech and Signal Processing, Vol. ASS-27, No. 2, pages 113–120; and B. Widrow et al, (1975), "Adaptive Noise Cancelling: Principles and Applications", Proceedings of the IEEE, 63 (12), pages 1692–1716). Works on this subject published more recently are also primarily based on modifications or expansions of these works. Further procedures for pause recognition in time-variant signals are not known.

SUMMARY OF THE INVENTION

The underlying aim of the invention is to indicate an improved method for pause recognition between patterns that are present in a measurement signal and that were modeled using hidden Markov models.

In general terms the present invention is a method for recognizing a signal pause between two patterns that are present in a time-variant measurement signal and that are recognized using hidden Markov models. In a first signal processing stage, feature vectors are formed periodically for pattern recognition, which describe the signal curve of the measurement signal within a time slice. No speech pause is detected by a pause detector contained therein in a first time slice on the basis of present features of a first feature vector. In a second signal processing stage, in a second time slice that follows the first time slice, the first feature vector is compared with at least two hidden Markov models, of which at least one has been trained to a pattern to be recognized and another has been trained to a pattern characteristic for a pause. If, in the comparison of the first feature vector with the hidden Markov models, a greater probability results for the presence of a pause, the information concerning the presence of a pause, the pause information, is forwarded to the pause detector in the first signal processing stage. There the measurement signal is treated as a signal pause, at least in the second time slice.

Advantageous developments of the present invention are as follows.

A defined sequence of patterns, a pattern sequence, can be recognized. The pause information is forwarded after the recognition of the pattern sequence over several time slices, so that in the first signal processing stage, at least in the time slice following the pattern sequence, the measurement signal is treated as a signal pause and not as a pattern to be recognized.

Many feature vectors are intermediately stored until a pattern sequence has been recognized. The pause information is forwarded after the recognition of the pattern sequences, so that in the first signal processing stage, at least in the time slice before the pattern sequence, the measurement signal is treated as a signal pause and riot as a pattern to be recognized.

Characteristics of the measurement signal are evaluated in the time domain in the first signal processing stage for pause recognition.

Characteristics of the measurement signal are evaluated in the spectral domain in the first signal processing stage for pause recognition.

Context-modeled hidden Markov models are used.

The measurement signal represents uttered speech.

Disturbances in the feature extraction stage of a speech processing system are suppressed.

A channel adaptation of a speech channel is carried out.

The measurement signal represents writing motions on a pad.

The measurement signal represents signal sequences of a message-oriented signaling method.

An advantage of the inventive method is that for the first time items of information that are obtained in different signal processing stages and that occur successively in time are used for pause detection. That is, the pause information is obtained by comparing a specific pause model with the feature vector of the measurement signal in a comparison stage, and is supplied back to the feature extraction stage of the pattern recognition, so that, in a further time slice in the feature extraction stage, the pause state can be taken into account in the measurement signal analysis.

The inventive method advantageously makes use of the information that certain pattern groups belong with one another, e.g., for words these are groups of phoneme patterns; in this way it is ensured that a pause must follow at least after the pattern group. This information is subsequently used advantageously in the feature extraction stage as the first processing stage of the method.

Advantageously, it is also ensured by the inventive method that a pause has to have occurred before the arrival of a pattern sequence to be recognized. This fact is likewise exploited during the pattern recognition.

Advantageously, the inventive method can be combined with known methods for pause recognition that evaluate characteristics of the measurement signal in the time domain and in the spectral domain. In this way, a higher detection rate can be achieved in the pattern recognition.

With the inventive method, speech patterns, writing patterns or signaling patterns can be particularly advantageously analyzed, since they occur in numerous technical applications and can be modeled in suitable fashion.

With the inventive method, it can be advantageously ensured that if no patterns are recognized a pause must be present; in this way, an increased detection rate is achieved in the pattern recognition, since an item of pause information can thereby be made available to the feature extraction stage even more reliably.

In the following, the invention is further explained on the basis of figures.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
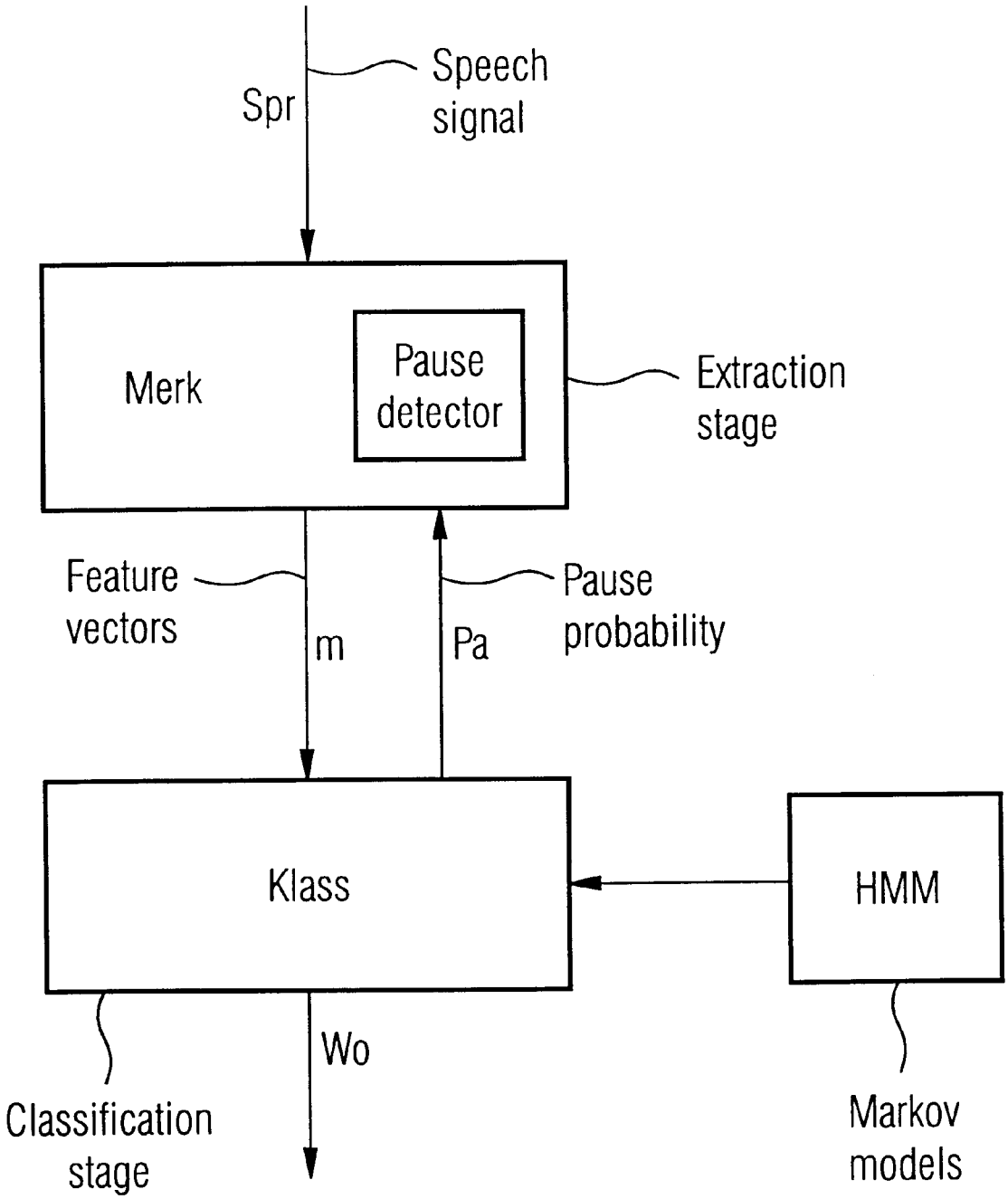
FIG. 1 shows a schematized example of a speech recognition system equipped with pause recognition.

FIG. 1 shows on the basis of an example, realized here as a speech recognition system, how the pause information is detected and forwarded, i.e. conducted back, according to the inventive method. The measurement signal, here as the speech signal Spr, first goes into a feature extraction stage Merk, which corresponds to the first signal processing stage in the inventive method. In this first signal processing stage, the spectral features of the speech signal or, respectively, of the measurement signal Spr are standardly analyzed. These features, which are subsequently outputted by the feature extraction stage, are here designated with m in FIG. 1. Next, the spectral features m go, e.g. as feature vectors, into a classification stage Klass, in which they are compared with the hidden Markov models HMM. The inventive method now begins here, by comparing the feature vectors obtained from the measurement signals in specific hidden Markov models for individual phonemes or, respectively, for pause states. In the training phase of the hidden Markov models, for example typical feature vectors are estimated for the background noise, as is also done for the useful signal. In this way, it is possible that in a continuous pattern comparison in each interval of analysis, the useful signal and the noise signal can be distinguished. In case of a very poor signal-noise ratio, a still higher robustness is achieved a) by means of a common evaluation of many analysis intervals and b) by means of a recognition of the useful signals, whereby all signals that are not recognized as the useful signal can be allocated e.g. to noise. The invention can advantageously be used in all known pattern recognition methods and can be combined with it. The inventive method is based in particular on the fact that the signal states and the feature vectors do not alter excessively from one time slice of the analysis interval to the next. In this way, an item of information obtained in the classification stage Klass can be forwarded to the feature extraction stage as pause information Pa, by determining e.g. that in the comparison of the hidden Markov models there is a higher probability for a pause than for a pattern to be recognized. It is highly probable that the time slice in which the pause is detected will be followed by a further time slice with a pause. By means of this procedure, undesired disturbances in the measurement signal can be suppressed in the formation of the feature vectors with great certainty, even with a low signal-noise ratio. Advantageously, by means of the inventive method the knowledge present in the recognition stage in a second time slice concerning the pause is transmitted to a first signal processing stage. This knowledge can for example be obtained from a speech signal via the acoustically phonetic modeling stage (hidden Markov models), which were already trained for speech recognition with a set of training data. In phoneme-based systems, the pause is trained at the same time as a model of a phoneme, and thus includes the statistics of the training data. More refined, and thus better, is the modeling taking into account the phoneme context, i.e. the knowledge of which phoneme follows another. If, for example, the pause decision of the acoustically phonetic modeling stage is combined with current criteria for pause estimation, an improvement of the pause decision can be achieved.

Figure 2:
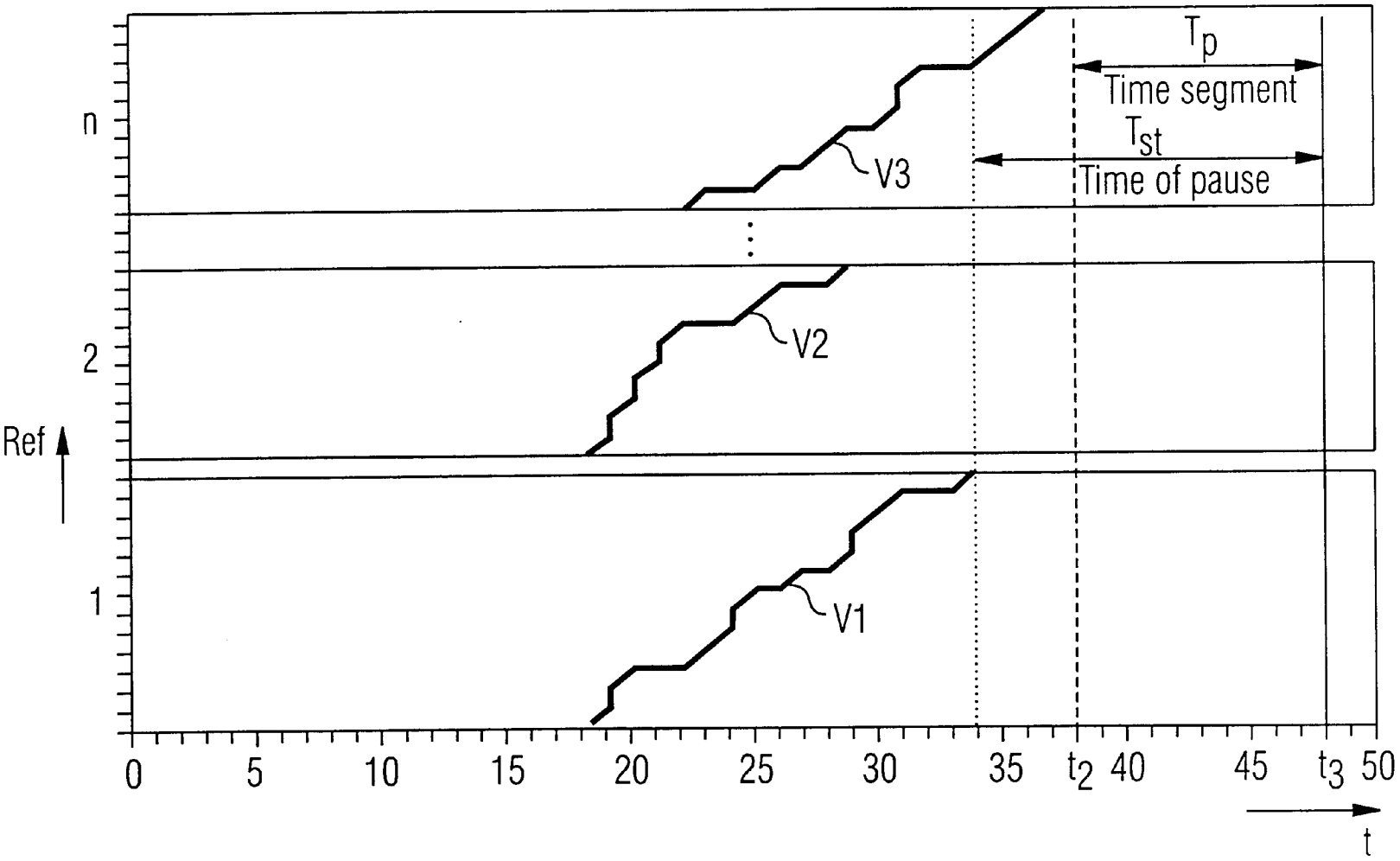
FIG. 2 illustrates the pause recognition process on the basis of various hidden Markov models.

FIG. 2 shows the different Viterbi paths V1 to V3 for different hidden Markov models. Here the connection between the pattern recognition and the presence of a pause between different patterns is shown over time. First the measurement signal, which is for example a speech signal, a writing signal or a signal emitted by signaling methods, is transformed into a feature vector space via a suitable signal transformation or several signal transformations. In a training phase of the pattern recognition method, typical models are for example estimated for the background noise and also for the useful signal, which are subsequently to be used in the recognition method. For the inventive method, the training can for example be realized using the method of the hidden Markov models. However, the pause recognition method can likewise be carried out with other pattern recognition methods, such as for example dynamic programming or neural networks. If hidden Markov models are used in the inventive method, then among other things the distribution functions of the feature vectors can for example be estimated for each recognition unit. In this connection, recognition units refers to speech sounds (phonemes) in automatic speech recognition. The inventive method was realized for automatic speech recognition by way of example, but it is conceivable that it can be used for any type of pattern recognition. It need only be ensured that signal patterns can be provided and that pause states are present in which the disturbing signals can be determined in order to train the hidden Markov models for pause states. Some examples of this sort for other pattern recognition methods include for example the patterns that occur in the signing of a document in the form of pressure- or time-dependent writing signals, or signal sequences that are used in automatic message-oriented signaling methods.

In the execution of the inventive method, in the recognition phase a continuous pattern comparison can for example calculate the probability of production for each recognition unit in each analysis interval, or, respectively, in each time slice. A simple solution is the evaluation of these probabilities. If the probability for a pause, thus, for the hidden Markov model, for a pause or the equivalent thereof, is at its highest, then the analysis interval concerned can be used for the new estimation of the distribution functions or for filtering out, given a noise suppression.

The inventive method becomes still more robust if the result of a pattern recognizer is taken into account as an additional source of knowledge. If it is presupposed that for example the pattern recognizer is able to recognize every possible useful signal, the inventive method can make use of this and can define as pause all other analysis intervals not classified as useful signal. Such a time segment is designated with $T_p$ in FIG. 2. If there is no demand for real-time processing in relation to the method, as is the case for example in simulations, the inventive method can hereby already count as sufficient for the pattern recognition. In practice, real-time criteria are to be used in the applications mentioned, and an allocation to the useful signal or noise signal must ensue as soon as possible. The method must thus for example be integrated into the recognition process itself. The recognition method is thus expanded according to the invention in such a way that after each analysis step it is for example evaluated which of the patterns, e.g. words, composed from the recognition units is the most probable. In addition, over a larger analysis interval the probability that this interval contains a signal pause is for example calculated. For example, the analysis interval is thereby dimensioned in such a way that in every case it is longer than short pauses, e.g. plosive pauses in the useful signal. This probability is then compared with that of the most probable pattern, whereby it is related to an equally long time interval. The result of this comparison can already be used as a decision.

Still higher demands are for example placed on speech recognition systems. In them, it must be avoided that the recognizer shuts off prematurely, thereby causing the output of a false word. In FIG. 1, the recognizer is designated Klass. These cases occur in particular with non-stationary disturbing noises. This can for example be prevented by an additional condition. For example, a signal pause is recognized as the end of a word only if, in addition to the criterion described above, the most probable word over a determined time span has always been the most probable word. This time span is designated $T_{ST}$ in FIG. 2. Through the combination of these two described criteria, a high reliability is obtained in pause recognition, which is important for the sure functioning of a speech recognizer.

The basic idea is, in a pattern recognition system, to exploit the knowledge sources present on different levels in signal processing stages for the detection of a pause. These extend for example to:

- characteristics of the signal in the time domain, such as for example zero crossing rate and level, as well as
- in the spectral domain, e.g. the power and the measure of correlation, including the logarithmic and/or feature domain.
- in addition, the inventive method detects the pause by realizing a feedback of the recognition stage to the feature extraction stage.

In this way, the information present in the various time slices concerning the presence of a pause in the classifier Klass is supplied to the feature extraction stage Merk. During the recognition, there ensues for example a dynamic pattern comparison, in which an allocation to the pre-trained models is made on the basis of the feature vectors in an analysis window or, respectively, in a time slice. A global search strategy, such as is realized e.g. by the Viterbi algorithm, finds the most probable sequence of pre-trained model states that reproduces the incoming sequence of feature vectors (L. R. Rabiner et al, (1986), "An Introduction to Hidden Markov Models", IEEE Transactions on Acoustics, Speech and Signal Processing, (1), pages 4–16).

Thus, in each time window the information about pause/non-pause can be picked off at the classifier Klass, and can be supplied to a pause detector in another stage. In the inventive method, this is for example realized in such a way that in the classifier a specific hidden Markov model for pause is compared with the incoming feature vectors; if a higher probability for pause occurs than for other patterns, a pause information signal is for example forwarded to the feature extraction stage Merk, and there leads to the decision that a pause is currently present. That is, with this pause information a pause detector already present in the extraction stage can also be controlled to set pause. This pause decision can for example be probability-weighted, and is based on a decision that takes into account other sources of knowledge within the inventive method. Such other knowledge sources include for example statistics of the measurement signal and the phoneme context from the Viterbi method. Based on the sequential structure of a recognizer, e.g. the delay by an analysis window must be taken into account, for example in a feeding back of the information to a pause detection stage for the suppression of disturbing noises. If, in speech recognition, the pause decision of the acoustically phonetic modeling stage is connected with current criteria for pause estimation, an improvement of the pause decision can be achieved. For example, if the frame-by-frame detection of the pauses is completely abandoned, a further knowledge source in the recognition system can be exploited for the pause estimation.

For example, different patterns that are connected and that also belong together can be detected as a whole, and conclusions can be drawn therefrom concerning the pauses present in the measurement signal. For example, such a global pause detector can provide its information about the entire pattern or pattern sequence to be recognized. In the case of speech recognition, such a pattern sequence would be for example a word to be recognized. All regions outside this pattern sequence can thus for example be recognized as pause. This has the advantage that even current disturbances go into the pause detection. The inventive method thus still functions even at very high disturbance levels, and is thus more robust. As a result of the design, a larger time delay is to be allowed for before a decision is present. This global pause detection stage is thus to be used particularly in connection with an intermediate signal storing. It is particularly suited for the preparation of the measurement signal, and can in particular serve for the recognition of the separation pauses between individual words or, respectively, sequences of patterns to be recognized. An inventive system for pattern recognition and pause recognition can be described in summary fashion in the following stages.

1. Taking into account of the signal characteristics in the time domain (e.g. zero crossing rate, level);
2. Additional taking into account of the characteristics in the spectral domain (e.g. power, correlation measure), including the logarithmic and/or feature region;
3. Additional taking into account of the frame-by-frame pattern comparison with pre-trained pause models;
4. Additional taking into account of the feedback of the decision of the pause detector integrated into the global recognition.

For example, an embodiment of the inventive method is described by the pseudo-code shown in Table 1.

TABLE 1

```
main()
do                                  !Time loop
signal_analysis()                   !Transformation of the
                                    !measurement signal into a
                                    !feature region
    calculate_word_pb()             !calculates the probability for each
                                    !reference word, e.g. with hidden
                                    !Markov models and Viterbi decoding;
                                    !this is the composite probability
                                    !that all previous feature vectors
                                    !were emitted by the respective word
                                    !model
    calculate_pause_pb()            !calculates the probability for
                                    !pause for the last P time
                                    !steps; this is the composite
                                    !probability that the last P
                                    !feature vectors were emitted by
                                    !the model for 'Pause'
    pausedetector()                 !sets pause to 1, if the
                                    !probability for pause is higher
                                    !than for the best word,
                                    !otherwise pause = 0
                                    !Thereby standardization of the
                                    !probabilities to the same time
                                    !duration P
    if(pausw&&word_stable > x)break
                                    !Abort, if pause is recognized
                                    !by pausedetector() (pause) and
                                    !the best word at least since x
                                    !magazines [sic:"time steps" ]
                                    !uninterrupted is the best
                                    !(word _stable)
    enddo
    output()                        !output recognized word
end
```

By way of example, the inventive method is realized in a main program that is bounded by main and end. This main program essentially contains a do loop as a time loop. A transformation of the measurement signal into a feature region is carried out with a procedure signal_analysis. For example, a specific time slice of the measurement signal is analyzed and feature vectors from this time slice are applied.

The applied feature vectors are subsequently analyzed in a subroutine calculate-word pb. For example, there the probability is calculated for each reference word, e.g. with hidden Markov models and using Viterbi decoding. The composite probability that all previous feature vectors were emitted is thereby calculated. In an additional subroutine calculate_pause_pb, the probability for pause is calculated for the last P time steps. Here as well, the composite probability is calculated that the last P feature vectors were emitted by the model for pause. In a further subroutine pause detector, a pause information signal is generated if the probability for pause is higher than for the best word; otherwise the pause information is not produced. For example, a standardization of the probability to be taken into account to the same time duration P is carried out here. In a further query, if (pause && word_stable>x) break, an abort of the method is carried out if pause has been recognized by the pause detector, and the best word at least since x time steps uninterrupted is stable (word_stable). With the subroutine output, the recognized pattern sequence, a word in the case of speech recognition, is outputted.

The invention is not limited to the particular details of the method depicted and other modifications and applications are contemplated. Certain other changes may be made in the above described method without departing from the true spirit and scope of the invention herein involved. It is intended, therefore, that the subject matter in the above depiction shall be interpreted as illustrative and not in a limiting sense.

What is claimed is:

1. Method for recognizing a signal pause between two patterns that are present in a time-variant measurement signal and that are recognized using hidden Markov models, comprising the steps of:

a) periodically forming in a first signal processing stage, feature vectors for pattern recognition, which describe a signal curve of a measurement signal within a time slice, no speech pause being detected by a pause detector contained therein in a first time slice based on present features of a first feature vector;

b) comparing the first feature vector, in a second signal processing stage, in a second time slice that follows the first time slice with at least two hidden Markov models, of which at least one has been trained to a pattern to be recognized and another has been trained to a pattern characteristic for a pause;

c) forwarding, if in the comparison of the first feature vector with the hidden Markov models, a greater probability results for the presence of a pause, pause information concerning the presence of a pause to a pause detector in the first signal processing stage, and therein treating the measurement signal as a signal pause, at least in the second time slice.

2. The method according to claim 1, wherein a defined sequence of patterns is recognizable, and wherein the pause information is forwarded after recognition of the pattern sequence over several time slices, so that in the first signal processing stage, at least in a time slice following the pattern sequence, the measurement signal is treated as a signal pause and not as a pattern to be recognized.

3. The method according to claim 2, wherein feature vectors are intermediately stored until a pattern sequence has been recognized, and wherein the pause information is forwarded after recognition of the pattern sequences, so that in the first signal processing stage, at least in a time slice before the pattern sequence, the measurement signal is treated as a signal pause and not as a pattern to be recognized.

4. The method according to claim 1, wherein characteristics of the measurement signal are evaluated in the time domain in the first signal processing stage for pause recognition.

5. The method according to claim 1, wherein characteristics of the measurement signal are evaluated in the spectral domain in the first signal processing stage for pause recognition.

6. The method according to claim 1, wherein the Markov models are context-modeled hidden Markov models.

7. The method according to claim 1, wherein the measurement signal represents uttered speech.

8. The method according to claim 7, wherein disturbances in a feature extraction stage of a speech processing system are suppressed.

9. The method according to claim 7, wherein a channel adaptation of a speech channel is carried out.

10. The method according to claim 1, wherein the measurement signal represents writing motions on a pad.

11. The method according to claim 1, wherein the measurement signal represents signal sequences of a message-oriented signaling method.

* * * * *